US011272776B2

(12) United States Patent
Gibbs

(10) Patent No.: US 11,272,776 B2
(45) Date of Patent: Mar. 15, 2022

(54) BACK SOLUTION APPLICATOR

(71) Applicant: Paul Gibbs, Lindenwood, NJ (US)

(72) Inventor: Paul Gibbs, Lindenwood, NJ (US)

( * ) Notice: Subject to any disclaimer, the term of this patent is extended or adjusted under 35 U.S.C. 154(b) by 0 days.

(21) Appl. No.: 17/088,737

(22) Filed: Nov. 4, 2020

(65) Prior Publication Data

US 2021/0186182 A1 Jun. 24, 2021

Related U.S. Application Data

(60) Provisional application No. 62/949,851, filed on Dec. 18, 2019.

(51) Int. Cl.

| | |
|---|---|
| ***A46B 5/02*** | (2006.01) |
| ***A45D 40/26*** | (2006.01) |
| ***B65D 47/42*** | (2006.01) |
| ***A46B 11/00*** | (2006.01) |

(52) U.S. Cl.

CPC ..... *A45D 40/26* (2013.01); *A46B 11/0037* (2013.01); *B65D 47/42* (2013.01); *A45D 2200/055* (2013.01); *A45D 2200/1009* (2013.01); *A45D 2200/1081* (2013.01)

(58) Field of Classification Search

CPC ..... A45D 40/26; A45D 2200/055; A45D 2200/1081; A45D 2200/1009; B65D 47/42; A46B 11/0037

USPC ..... 401/6, 188 R, 176, 179

See application file for complete search history.

(56) References Cited

U.S. PATENT DOCUMENTS

| | | | | |
|---|---|---|---|---|
| 6,009,887 | A * | 1/2000 | Hertel | A45D 34/042 132/317 |
| 6,726,385 | B1 * | 4/2004 | Borowski | A46B 9/005 401/187 |
| 6,817,801 | B1 * | 11/2004 | Colburn | A47L 1/15 401/204 |
| 7,309,180 | B2 * | 12/2007 | Russell | A45D 34/041 401/1 |
| 8,360,668 | B1 * | 1/2013 | Hinnant | A46B 11/0096 401/188 R |
| 2011/0311298 | A1 * | 12/2011 | McGee | A45D 40/26 401/188 R |

* cited by examiner

*Primary Examiner* — Jennifer C Chiang

(74) *Attorney, Agent, or Firm* — Brennan, Manna & Diamond, LLC

(57) ABSTRACT

The present invention relates to a multi-fluid solution applicator device that is suitable for use with lotions, soaps, creams, oils, medicines and the like, and that can be used to apply the same to the center of a user's back and other hard to reach areas. The solution applicator of the present invention eliminates the need for assistance from another individual to apply a solution to an area of the user's body, and features an elongated handle, a housing, a reservoir having related conduit, and a repositionable applicator for dispensing the solution from the reservoir.

9 Claims, 3 Drawing Sheets

BACK SOLUTION APPLICATOR

CROSS-REFERENCE TO RELATED APPLICATION

The present application claims priority to, and the benefit of, U.S. Provisional Application No. 62/949,851, which was filed on Dec. 18, 2019 and is incorporated herein by reference in its entirety.

BACKGROUND

The present invention relates generally to the field of solution applicators. More specifically, the present invention relates to a multi-fluid solution applicator suitable for use with lotions, soaps, creams, oils and the like, and to apply the same to the center of the user's back and other hard to reach areas. The solution applicator of the present invention eliminates the need for assistance from another individual to apply a solution to an area of the body, and features an elongated handle with an attached tilted head and a small reservoir for dispensing the solution onto, for example, the back of the user. The solution applicator alleviates the problem of a user having to engage in painful and uncomfortable twisting and contorting to reach certain areas of the user's body. Accordingly, the present disclosure makes specific reference thereto. Nonetheless, it is to be appreciated that aspects of the present invention are also equally amenable to other like applications, devices and methods of manufacture.

By way of background, people often use and apply various types of lotions, soaps, oils or other solutions to various parts of the body. For example, lotions and skin creams are applied to the skin to treat a variety of ailments including, but not limited to, dryness, burns, skin disease, rashes and other ailments. Unfortunately, it is oftentimes difficult for a person to apply a lotion to certain parts of their own body, such as their back and the posterior areas of their legs. Further, this becomes impossible for people who suffer from physical ailments that limit their movement generally, and particularly their bending and stretching capabilities. The difficulty in applying lotions to the back or other posterior areas of body leads to either uneven application of the lotion, or no application at all. Similarly, the inability of a user to apply a soap or gel/foam cleanser to the whole body while taking a bath could leave the user feeling dirty, and result in unclean areas of the body. Additionally, the limited stretching capability of most users makes it difficult for a user to apply soap or lotion to the back and posterior areas, thereby causing the accumulation of dirt and dead skin on such areas. The prolonged accumulation of dirt and dryness may cause skin diseases, allergies, rashes or the like, which can cause greater discomfort to the users.

While some lotion applicator devices, such as handheld pads, exist in the art, the same require the user to pour lotion onto the applicator and then apply the applicator to the desired portion of the body. Once the lotion on the applicator is consumed or applied, the user must repeat the process, oftentimes over and over. Unfortunately, this process of pouring the lotion onto the applicator again and again is frustrating, time consuming and causes inconvenience to the user. Further, the user has very little, if any, control over the amount of lotion being applied to the affected area, as the lotion tends to roll or drip off the applicator before it can be positioned against the desired portion of the body.

Furthermore, conventional lotion applicator devices require a separate lotion or other solution container to be carried along for applying the lotion to the body, which a user may forget to bring with them when getting into the bath or shower. Unfortunately, without said lotion or soap, the applicator is of little value and does not serve its intended purpose. Additionally, when applying soaps and body scrubs to the back portion of the user's body and posterior areas of the legs, the user oftentimes requires a separate back scrubbing device, thereby requiring the user to carry yet another item with them into the shower or bath.

Therefore, there exists a long felt need in the art for a lotion or solution applicator device that enables a user to easily apply lotion, oil, sunscreen, cream, soap or the like on hard-to-reach body parts, thereby preventing skin ailments such as dryness, rashes, burns, allergies and the like. There also exists a long felt need in the art for a solution applicator device that does not require a user to repeatedly pour lotion, oil, cream, soap or the like onto the applicator, only to have a portion of it fall off of the applicator prior to it being applied to the body. Further, there is a long felt need in the art for a single solution applicator device that reduces the number of items that a user must carry with him or her into a shower or bath. Additionally, there is a long felt need in the art for a solution applicator device that enables the user to control the amount of lotion or soap to be dispensed through the end of the applicator. Finally, there is a long felt need in the art for a solution applicator device that can be used to both apply lotions, creams, oils, soaps, medical ointments and scrub the user's back, posterior area of the legs, and other hard to reach areas of the body.

The subject matter disclosed and claimed herein, in one embodiment thereof, comprises a solution applicator device having a housing, one or more bladder(s) or reservoir(s) adapted to store a quantity of lotion positioned within the housing, a plunger mechanism, an applicator and a telescoping handle. More specifically, the housing is attached to the telescopic handle at the proximal end, and an applicator is positioned near the distal end of the handle to apply the lotion from the bladder to the body via the plunger mechanism. The solution applicator device is capable of being used to apply lotions, creams, oils, soaps, sunscreens and the like to hard to reach portions of the user's body, without the assistance of another.

In this manner, the back solution applicator device of the present invention accomplishes all of the forgoing objectives, and provides a relatively quick and easy solution to the need to apply lotions, oils, creams, soaps or the like to hard to reach body areas according to the preferences of the user. The solution applicator device of the present invention is also user friendly inasmuch as it includes a reservoir with lotion stored therein, and an easy to use plunger-based solution dispensing mechanism for controlling the amount of solution to be dispensed.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

The subject matter disclosed and claimed herein, in one embodiment thereof, comprises a lotion applicator device having a bladder or reservoir adapted to store a quantity of lotion, and a housing within which the bladder is enclosed. The housing includes a proximal end and a distal end, and the housing is attached to a telescopic handle at the proximal end. An applicator is provided near the distal end of the handle to apply the stored lotion to the body, and a plunger mechanism is used to dispense the lotion from the bladder to the applicator upon demand and refill the bladder with lotion. The lotion applicator device is also capable of being used with other user specified solutions, such as creams, oils, soaps, cleaning solutions, fragrances, ointments, sunscreens, medications and the like.

The subject matter disclosed and claimed herein, in an alternative embodiment, comprises a back solution applicator that is comprised of a housing, a bladder, a refillable quantity of a lotion, an applicator and a pump mechanism that supply the lotion stored in the bladder to the applicator upon demand. The housing of the back solution applicator device provides an elongated structure that enables the user to extend his or her reach to make the lotion or solution application process easier. The back solution applicator further comprises a handle, and an arm connecting the housing and the applicator to facilitate the flow of the lotion from the bladder to the applicator. An optional attachment for the applicator, which could be a sponge, brush, pumice stone, etc., may also be attached, wherein the individual uses the applicator member and the optional attachment to apply the liquid, lotion or other solution to one's own body and scrub the same.

In a further embodiment of the present invention, a method for easily applying a moisturizing lotion, sunscreen, cream, soap or any other solution or product to areas of the body that are difficult to reach is disclosed. The method includes the steps of initially holding a handle of the solution applicator device of the present invention in one hand, and then activating a plunger to fill a reservoir with the lotion or solution. Next, the plunger is pressed in a downward motion (i.e., in the direction of the rest of the device) to dispense a suitable amount of the lotion from inside the reservoir and onto an applicator end. The lotion dispenses onto the applicator end through a hose connection that is in fluid communication with the reservoir. Finally, the lotion is dispensed through an opening on the applicator end, which the user applies or spreads as desired by moving the applicator end in different directions to cover various areas of the body to be treated.

In a further exemplary embodiment of the present invention, a personal applicator for dispensing solutions is described. The personal applicator is comprised of an elongated handle defining a housing, with the handle having a first and a second end. The first end of the handle has a gripping portion for easy and secure handling of the device, and the second end has an applicator for applying the solution to a body part. The housing has a holding tank for containing a supply of solution, and the holding tank has a plunger provided on one end and a conduit on a second end, wherein the conduit is connected to and in fluid communication with the applicator. The plunger creates a negative pressure to dispense a solution from the tank to the applicator, and the applicator is adjustable up to 150° from a vertical or longitudinal axis of the housing. The applicator has at least one opening for dispensing the solution, and the applicator further includes a removable head disposed over a surface of the applicator and the at least one opening.

In a still further exemplary embodiment of the present invention, a device for applying solutions to the back of an individual is disclosed, wherein the device comprises a housing and an elongated handle. The housing has a bladder for containing a supply of solution, a pump handle positioned at one end of the handle, and a conduit extending to a second end of the handle. The pump handle creates a negative pressure to dispense the supply of material through the conduit and to an applicator. The applicator is pivotable up to 150° from a vertical or longitudinal axis of the housing, and the applicator has a removable head selected from a group including a sponge, brush, pumice stone or combinations thereof, and the applicator has at least one opening for the supply of material to pass through.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and is intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION

Figure 1:
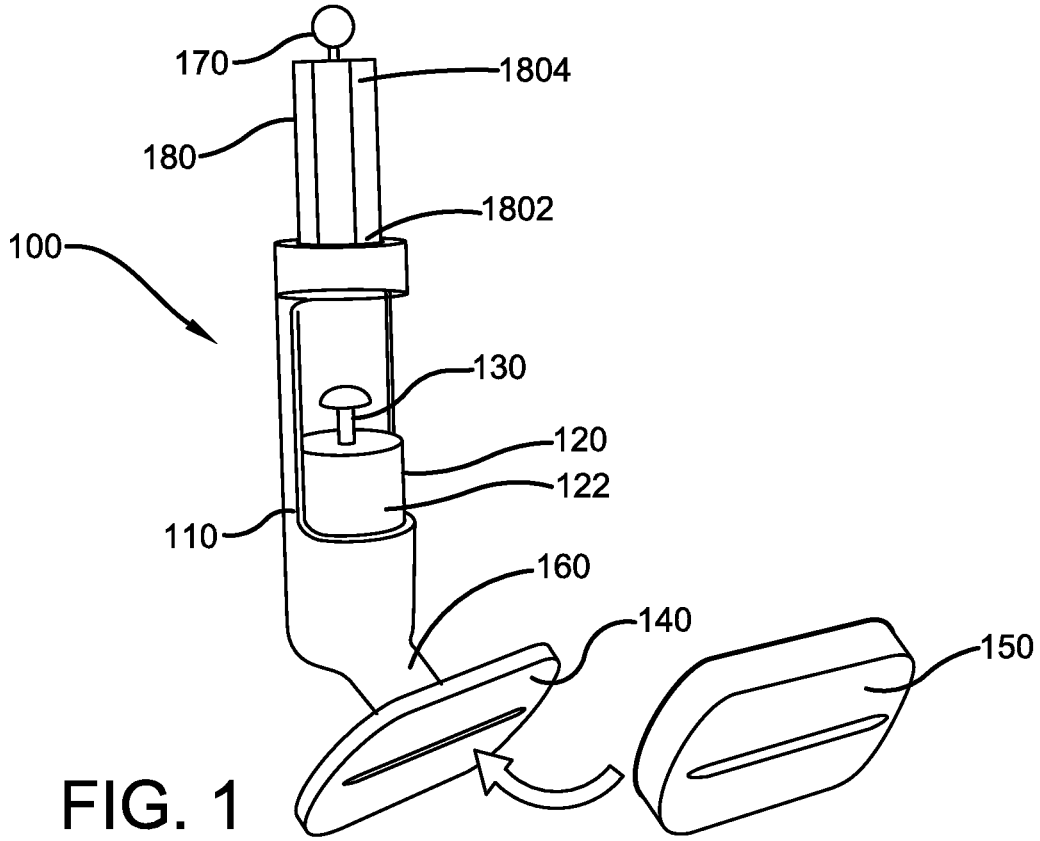
FIG. 1 illustrates a perspective view of one potential embodiment of the handheld lotion applicator device of the present invention in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention, nor do they limit the scope of the invention. Additionally, an illustrated embodiment need not have all of the aspects or advantages shown. Thus, in other embodiments, any of the features described herein from different embodiments may be combined.

As noted above, there is a long felt need in the art for a lotion or solution applicator device that enables a user to easily apply lotion, oil, sunscreen, cream, soap, medication, ointment or the like to hard-to-reach body parts, such as the back and posterior areas of the user's legs. There is also a long felt need in the art for a solution applicator device that does not require a user to repeatedly pour lotion, oil, cream, soap or the like onto the applicator, only to have a portion of it fall off of the applicator prior to it being applied to the body. Further, there is a long felt need in the art for a single or unitary applicator device that reduces the number of items that a user must carry with him or her into a shower or bath, and for a solution applicator device that enables the user to control the amount of lotion or soap to be dispensed through the end of the applicator, thereby conserving lotion and improving overall efficiencies. Finally, there is a long felt need in the art for a solution applicator device that can be used to both scrub the surface of the user's skin and apply lotions, creams, oils, soaps, medical ointments and the like to hard to reach areas of the user's body.

Referring initially to the drawings, FIG. 1 illustrates a perspective view of one potential embodiment of the handheld lotion applicator device 100 of the present invention in accordance with the disclosed architecture. Handheld lotion applicator device 100 is preferably comprised of a housing 110, a bladder or reservoir 120, a pump or plunger mechanism 130, an applicator 140, an arm 160, a handle 180 and a conduit 220. Nonetheless, as explained more fully below, handheld lotion applicator device 100 may further comprise a plurality of different attachments or accessories 150 that may be attached to the applicator 140. For example, an optional attachment 150 for the applicator 140 could be any of a sponge, brush, pumice stone, etc.

More specifically, and as best shown in FIGS. 1 through 4, lotion applicator 100 provides an elongated structure that enables a user 500 to extend his or her reach to make the process or applying a solution, soap, shampoo, lotion 122 and the like to, for example, the user's back 510 easier and more efficient. The housing 110 houses of contains the bladder 120 (which may be the reservoir itself or separate and apart from the reservoir depending upon the particular embodiment of the present invention), the pump or plunger 130 and the conduit 220. The arm 160 connects the housing 110 to the applicator 140 to facilitate the flow of the lotion 122 from the bladder 120 to the applicator 140 via conduit 220 when the pump 130 is activated by the user 500.

The pump 130 is preferably made from a durable plastic, typically polypropylene, and may also include a lock to prevent the premature or unwanted flow of lotion 122 to the applicator 140 from the reservoir 120, for example, when the lotion applicator 100 is not in use. The lock may be engaged by twisting the pump handle so that it is in a locked position. The pump 130 is preferably a mechanical pump and works like an air suction device to draw lotion 122 from the reservoir 120 to the applicator 140 head by creating a negative pressure therein. Most body washes, shampoos and the like have a viscosity of between 5,000 and 20,000 centipoises (CP or CPS). Therefore, ideally, the pump 130 is capable of withdrawing such fluids or substances having a viscosity of between 1 and 20,000 CPS, and more preferably between 100 and 10,000 CPS. Further, an ideal withdrawal rate is believed to be in increments of 0.2 to 10 cc of solution 122 per pump cycle, and more preferably between 0.5 to 4 cc (0.5 ml to 4 ml) per pump cycle.

The handle 180 is a generally cylindrically shaped and elongated structure comprising a first end 1802 and a second end 1804. The housing 110 may be fitted to the open first end 1802 of the handle 180 by snap fit, screw fit or through any other fastening mechanism known in the art. The second end 1804 of the handle 180 is preferably closed and may further comprise a mounting loop 170 attached thereto for mounting the solution applicator device 100 on a hook, nail, screw or the like for convenient storage, when not in use. Alternatively, the handle 180 may have an opening on the second end 1804 to hang the device 100 on a wall mounted hook for storage, when the device is not in use. The handle 180 is preferably telescopic and can be adjusted to a length as per the needs and/or preferences of the individual user 500. The handle 180 may further comprise a grip, texture or grooved pattern for the secure and easy handling of the lotion applicator device 100 by the user 500, particularly while the same is wet or slippery with the lotion 122. The handle 180 may be comprised of a durable plastic, metal, wood or any other suitable material as per the wants and needs of the user 500. The handle 180 and/or housing 110 of the applicator device 100 may further comprise a logo, signature, trademark, or design to enhance the aesthetic appearance of the device.

Figure 2:
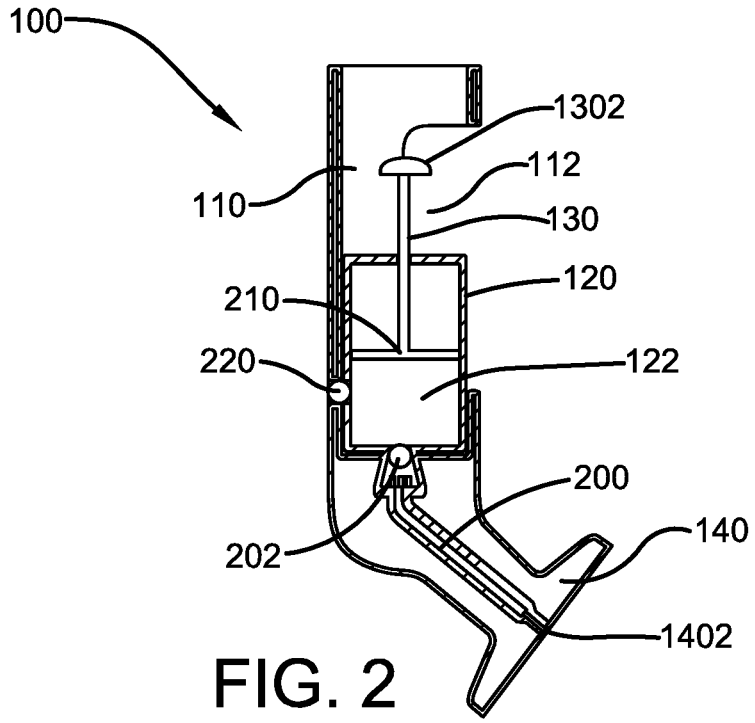
FIG. 2 illustrates a cross sectional perspective view of one potential embodiment of the handheld lotion applicator device of the present invention in accordance with the disclosed architecture.

FIG. 2 illustrates a cross sectional perspective view of one potential embodiment of the handheld lotion applicator device 100 of the present invention in accordance with the disclosed architecture. More specifically, bladder 120 is a generally cylindrical shaped holding tank adapted to hold approximately 3 ounces (90 ml or 90 cc) of lotion 122, or roughly the amount of lotion 122 required to complete multiple full body applications of the lotion 122. The lotion 122 is filled into the bladder 120 using plunger 130. More specifically, when the plunger or pump 130 is pulled up using a plunger head 1302, the lotion 122 is forced or pulled through a conduit 220 and into the bladder 120. The conduit 220 is only open when the plunger 130 is being pulled upward, and is closed in all other instances to prevent the lotion 122 from escaping therethrough.

Once the bladder 120 contains the lotion 122, the plunger 130 may be pressed downward (i.e., in the direction of the applicator) by the user 500 by pressing down the plunger head 1302, and the downward pressure of the plunger 130 activates a piston 210 disposed in the bladder 120 and causes the lotion 122 to dispense through a hose connection 202 to the applicator end 1402 so that the lotion 122 is applied to the desired body part. Importantly, the hose connection 202 is only opened when the plunger 130 is being pushed downward (i.e., in the direction of hose connection 202), and is closed in all other instances to prevent the lotion 122 from escaping therethrough.

The applicator 140 allows the user 500 to control the amount of lotion 122 applied (e.g., by how far the plunger 130 is allowed to travel), and reduces the amount of wasted lotion 122. The applicator end 1402 is shown generally as a slot that runs generally parallel with the side edges of the applicator 140, and is generally centrally disposed in the applicator 140. In alternative embodiments, the applicator end 1402 may include a series of individual openings 1403 placed around the head area or rows of openings 1405 spaced on the applicator to aid in the application of the lotion, as best shown in FIG. 6. Further, the applicator 140 may be made of a foam, sponge, plastic or any other material to approximate the soft, pliable feeling of a human hand. During refill, the piston 210 may travel backwards or upwards within the bladder 120, to enable a refill or otherwise reduce the pressure in the bladder 120. At the bottom of the bladder 120, a supply tube 200 directs the flow of the lotion 122 to the applicator end 1402 that distributes the lotion 122 onto the applicator 140. The supply tube 200 is in fluid communication with the bladder 120 through a hose 202, and the user 500 may control the rate of the flow of the lotion 122 to the applicator 140 using the force on the plunger head 1302. In an exemplary embodiment, the plunger 130 controls the operation of the piston 210, and the applicator 140 is removably attached to the body of the lotion applicator device 100.

Figure 3:
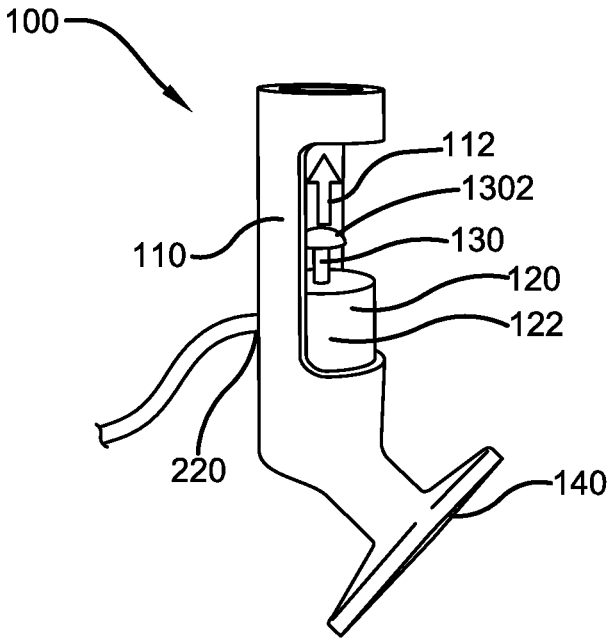
FIG. 3 illustrates a perspective view of one potential embodiment of the lotion applicator device of the present invention in accordance with the disclosed architecture, and showing the plunger action pulling the lotion into the bladder.

FIG. 3 illustrates a perspective view of one potential embodiment of the lotion applicator device 100 of the present invention in accordance with the disclosed architecture, and showing the plunger 130 action pulling the lotion 122 into the bladder 120. More specifically, to fill or refill the bladder 120 with the lotion 122, a plunger 130 is pulled upwards (i.e., away from the applicator 140) using a plunger head 1302. A tube or a conduit 220 (or alternatively a separate reservoir, as mentioned elsewhere herein) contains the lotion 122 to be used to fill the bladder 120. Once the plunger 130 is moved in an upward direction 112, a piston present in the bladder 120 is activated and a pressure difference is created between the bladder 120 and the conduit 220, thus pulling the lotion 122 from the conduit 220 and into the bladder 120 through an opening connecting the conduit 220 and the bladder 120. The bladder 120 may be manipulated or rotated within the housing 110 in any desired direction.

Figure 4:
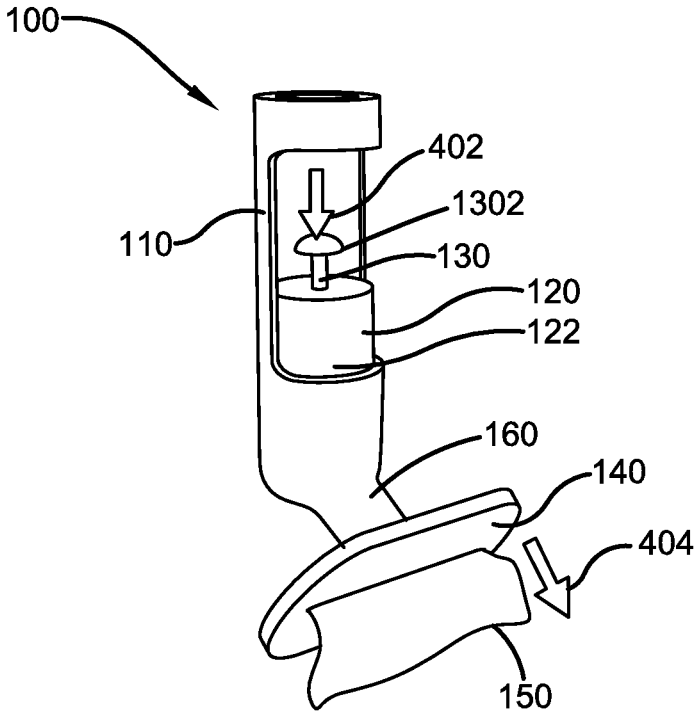
FIG. 4 illustrates a perspective view of one potential embodiment of the lotion applicator device of the present invention in accordance with the disclosed architecture, and showing the plunger pushing the lotion from the bladder to the applicator via the conduit.

FIG. 4 illustrates a perspective view of one potential embodiment of the lotion applicator device 100 of the present invention in accordance with the disclosed architecture, and showing the plunger 130 pushing the lotion 122 from the bladder 120 to the applicator 140 via the conduit. More specifically, a piston 210 is disposed within the bladder 120 and a plunger means 130 communicates with the piston 210 to dispense the lotion 122 from the bladder 120 to the applicator 140, and subsequently to the body 530 of the user 500 in the general direction 404 shown in FIG. 4. Stated differently, when the user 500 pushes the plunger 130 in the downward direction 402 (i.e., in the direction of the applicator 140), the piston 210 present within the bladder 120 is displaced in a downward direction so as to force or dispense the lotion 122 through a hose opening and a supply tube present inside an arm 160 of the applicator 140 and, possibly, an optional attachment 150. The optional attachment 150 may be porous, which may create a lather or a foam, and enables the user 500 to more effectively clean, scrub and/or oil the user's body 530. Further, the supply tube present in the arm 160 is preferably at an acute angle with respect to the housing 110, thereby creating a more effective flow of the fluid 122 towards the applicator 140. The arm 160 may be comprised of a flexible material, such as a BPA-free durable plastic, which may be bent or pivoted up to about 150° from the vertical or longitudinal axis of the housing 110 to achieve a number of different application positions to facilitate application of the lotion 122 to the body 530 of the user 500.

Figure 5:
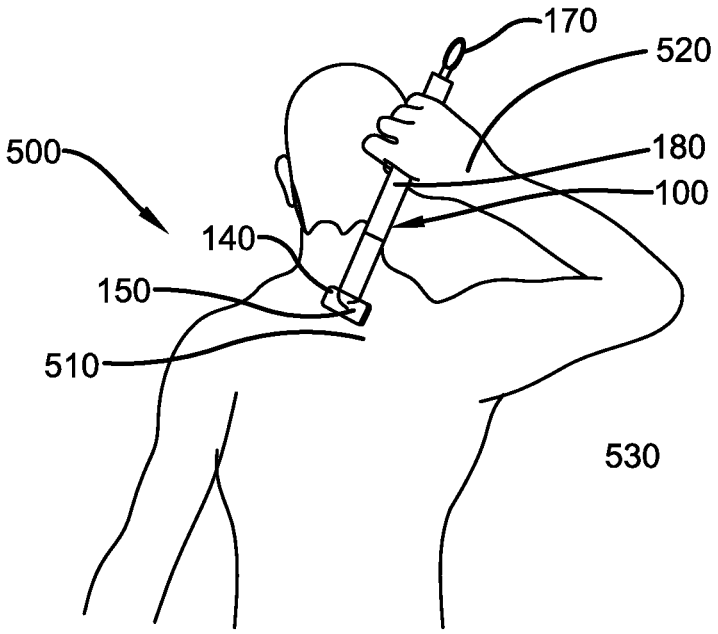
FIG. 5 illustrates a perspective view of one potential embodiment of the lotion applicator device of the present invention in accordance with the disclosed architecture and being used to apply lotion to a user's back area.

FIG. 5 illustrates a perspective view of one potential embodiment of the lotion applicator device 100 of the present invention in accordance with the disclosed architecture and being used to apply lotion to a user's back area 510. More specifically, a user 500 holds a handle 180 of the lotion applicator device 100 in one of its hands 520 and uses the other hand to push a plunger 130 to dispense the lotion 122 or other solution to the applicator 140 and an attachment 150 (if any) and then onto the back 510 of the user 500. The applicator 140 of the present invention is capable of applying the lotion, oil or other solution smoothly and evenly to hard-to-reach portions of the user's body 530, with a gentle yet powerful massaging action. In a further preferred embodiment, the applicator 140 is a four-inch wide, dense foam that provides a soft, gentle application of the lotion 122 over the user's skin. Nonetheless, it is understood that the applicator 140 may be provided in various shapes, sizes, and materials to accomplish the advantages described herein. Further, in a preferred embodiment, the applicator 140 is removable for cleaning and/or replacement, which helps to reduce the likelihood of clogging.

After use, the individual 500 may rinse off the applicator 140 with hot water and may hang it to dry using a mounting loop 170 attached to the handle 180. The handle 180 is ergonomic and easy to grip, thereby ensuring a comfortable and greater user experience. The bladder or reservoir of the product 100 may be filled with an oil, pain relief cream, sunscreen, medication, ointment or lotion, and the applicator 140 may be used to massage the same into hard-to-reach places of the user's body 530. The applicator 140 may have a nonabsorbent, washable, reversible, and removable sponge that makes it easy to apply any topical ointment.

Figure 6A:
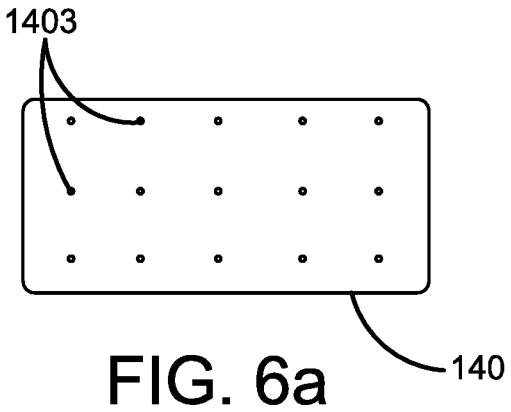
FIG. 6*a* illustrates a perspective view of an alternative embodiment of the applicator portion of the lotion applicator device of the present invention in accordance with the disclosed architecture.
Figure 6B:
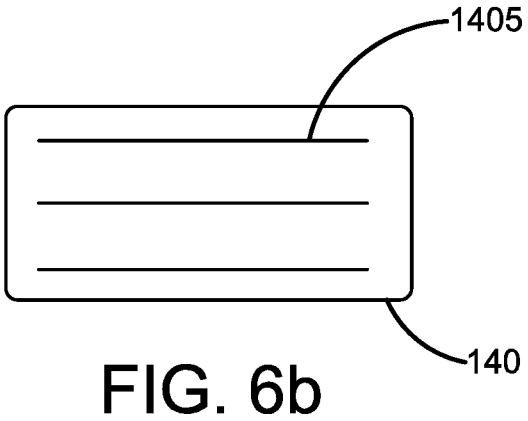
FIG. 6*b* illustrates a perspective view of a further alternative embodiment of the applicator portion of the lotion applicator device of the present invention in accordance with the disclosed architecture.

FIGS. 6*a* and 6*b* illustrate a perspective view of two alternative embodiments of the applicator portion of the lotion applicator device 100 of the present invention in accordance with the disclosed architecture. As previously stated, the applicator end 1402 may be a slot that runs generally parallel with the side edges of the applicator 140, and is generally centrally disposed in the applicator 140. However, as best shown in FIG. 6 and b, the applicator end 1402 may also include a plurality of spaced apart openings 1403 on the applicator head area, or rows of openings 1405 spaced on the applicator 140 to aid in the application of the lotion.

In one embodiment of the present invention, the applicator 140 of the device 100 of the present invention may further be utilized to massage one's back, or to scratch a difficult to reach area prior to or during lotion application. In a further embodiment of the present invention, the handle 180 of the device 100 may have a length of one to three feet, and may be telescoping. In an alternate embodiment, the handle 180 can be of fixed length and non-telescoping.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "lotion applicator device", "lotion applicator", "solution applicator device" and "back lotion applicator device" are interchangeable and refer to the lotion applicator device 100 of the present invention. As used herein, the terms "lotion" and "liquid" include gels, creams, pastes, foam, liquids, solid-liquid mixtures and mists which are known to be dispensed by various hand-sized pump and spray dispensers.

Notwithstanding the forgoing, the lotion applicator device 100 of the present invention can be of any suitable size and configuration as is known in the art without affecting the overall concept of the invention, provided that it accomplishes the above stated objectives. One of ordinary skill in the art will appreciate that the size, configuration and material of the lotion applicator device 100 as shown in the FIGS. are for illustrative purposes only, and that many other sizes of the lotion applicator device 100 are well within the scope of the present disclosure. Although the dimensions of the lotion applicator device 100 are important design parameters for user convenience, the lotion applicator device 100 may be of any size that ensures optimal performance during use and/or that suits user need and/or preference.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A personal applicator for dispensing solutions comprising:

a handle defining a housing, wherein the handle has a first end with a gripping portion and a second end having an applicator;

the housing having a holding tank for containing a supply of solution, the holding tank having a plunger and a conduit that is in fluid communication with the applicator, wherein the plunger creates a negative pressure to dispense a portion of the supply of solution from the holding tank to the applicator;

the applicator being pivotable from a longitudinal axis of the housing and the applicator having at least one opening for dispensing the portion of the supply of solution; and a removable head disposed over a surface of the applicator and the at least one opening.

2. The personal applicator for dispensing solutions of claim 1, wherein the portion of the supply of solution is dispensed in increments ranging from 0.2 cc to 10 cc per plunger cycle.

3. The personal applicator for dispensing solutions of claim 1, wherein the supply of solution contained within the holding tank has a viscosity ranging from 100 to 10,000 CPS.

4. The personal applicator for dispensing solutions of claim 1, wherein the removable head is selected from a group including a sponge, a brush, and a pumice stone.

5. The personal applicator for dispensing solutions of claim 1, wherein the holding tank has a capacity of up to 90 cc of the supply of solution.

6. A device for applying solutions to a portion of an individual, the device comprising:

a housing contained within an elongated handle, the housing having a bladder for containing a supply of material, the housing having a pump handle connected at a first end of the housing and a conduit connected at a second end of the housing, the pump handle creating a pressure in the bladder to dispense the supply of material;

an applicator attached to the elongated handle and to the supply of material via the conduit, the applicator pivotable from a longitudinal axis of the housing; and the applicator having a removable head selected from a group including a sponge, a brush, and a pumice stone, wherein the applicator is further comprised of at least one opening for the supply of material to pass through to the removable head.

7. The device for applying solutions to a portion of an individual of claim 6, wherein the supply of material is comprised of a solution having a viscosity ranging from 100 to 10,000 CPS.

8. The device for applying solutions to a portion of an individual of claim 6, wherein the supply of material is comprised of up to 90 cc of a solution.

9. The device for applying solutions to a portion of an individual of claim 7, wherein the solution is dispensed in increments ranging from 0.2 cc to 10 cc per pump cycle.

* * * * *